US007437848B2

(12) United States Patent
Chang

(10) Patent No.: US 7,437,848 B2
(45) Date of Patent: Oct. 21, 2008

(54) FIREARM AIMING AND PHOTOGRAPHING COMPOUND APPARATUS

(75) Inventor: Chia-Chun Chang, Taichung (TW)

(73) Assignee: Asia Optical Co., Inc., Taichung (TW)

( * ) Notice: Subject to any disclaimer, the term of this patent is extended or adjusted under 35 U.S.C. 154(b) by 205 days.

(21) Appl. No.: 11/456,637

(22) Filed: Jul. 11, 2006

(65) Prior Publication Data

US 2007/0214700 A1 Sep. 20, 2007

(30) Foreign Application Priority Data

Mar. 20, 2006 (TW) ..... 95204587 U

(51) Int. Cl.
*F41G 1/387* (2006.01)
*F41G 1/00* (2006.01)

(52) U.S. Cl. ..... 42/119; 42/122; 42/142

(58) Field of Classification Search ..... 42/119, 42/122–127, 142
See application file for complete search history.

(56) References Cited

U.S. PATENT DOCUMENTS 2,359,032 A * 9/1944 Gott ..... 89/41.15
3,659,494 A * 5/1972 Philbrick et al. ..... 89/28.05
3,709,124 A * 1/1973 Hunt ..... 396/426
3,711,638 A * 1/1973 Davies ..... 348/143
3,798,796 A * 3/1974 Stauff et al. ..... 434/20
4,256,013 A * 3/1981 Quitadama ..... 89/41.05
4,644,845 A * 2/1987 Garehime, Jr. ..... 89/41.05
5,669,174 A * 9/1997 Teetzel ..... 42/115
6,269,581 B1 * 8/2001 Groh ..... 42/122
6,499,382 B1 * 12/2002 Lougheed et al. ..... 89/41.05
6,519,083 B2 * 2/2003 Heinrich ..... 359/422
6,615,531 B1 * 9/2003 Holmberg ..... 42/142
6,813,025 B2 11/2004 Edwards
6,886,287 B1 * 5/2005 Bell et al. ..... 42/120
6,898,890 B2 * 5/2005 Gaber ..... 42/123
6,988,331 B2 * 1/2006 Holmberg ..... 42/142
2003/0163943 A1 * 9/2003 Holmberg ..... 42/142
2004/0079018 A1 * 4/2004 Holmberg ..... 42/142
2004/0200117 A1 * 10/2004 Gaber ..... 42/123
2005/0195385 A1 * 9/2005 Holmberg ..... 356/8
2005/0252063 A1 * 11/2005 Flannigan ..... 42/119

* cited by examiner

*Primary Examiner*—Bret Hayes
(74) *Attorney, Agent, or Firm*—Thomas, Kayden, Horstemeyer & Risley

(57) ABSTRACT

A firearm aiming and photographing compound apparatus. A digital sight is disposed on a firearm body and includes an image processing module and a receiver electrically connected thereto. A remote-control transmitter is connected to the firearm body, emitting a signal. The receiver receives the signal, actuating the image processing module.

8 Claims, 2 Drawing Sheets

FIREARM AIMING AND PHOTOGRAPHING COMPOUND APPARATUS

BACKGROUND OF THE INVENTION

1. Field of the Invention

The invention relates to a firearm aiming and photographing compound apparatus, and in particular to a firearm aiming and photographing compound apparatus with a remote-control transmitter.

2. Description of the Related Art

Firearms, such as rifles or shotguns, are often equipped with digital sights providing aiming and photographic functions.

In a conventional digital sight, buttons controlling photography are assembled on a main body thereof. When a user aims at a target using the digital sight of a rifle and is ready to shoot the target, one hand thereof must support a butt of the rifle and the other hand slightly contact a trigger of the rifle. At this point, when the user also wants to capture an image of the target using the digital sight providing photographic functions, the hand previously supporting the butt needs to move to the digital sight, pressing the buttons controlling photography. Accordingly, during movement of the hand from the butt to the digital sight, a line of sight of the user may leave the target, thereby causing aiming errors. Additionally, as the hand of the user is moved to the digital sight, the other hand slightly contacting the trigger must bear the entire weight of the rifle. Accordingly, heavy burden is exerted on the other hand of the user, adversely affecting precision of aiming at or photographing the target.

Hence, there is a need for a firearm aiming and photographing compound apparatus enhancing precision and convenience of aiming at or photographing a target.

BRIEF SUMMARY OF THE INVENTION

A detailed description is given in the following embodiments with reference to the accompanying drawings.

An exemplary embodiment of the invention provides a firearm aiming and photographing compound apparatus comprising a firearm body, a digital sight, and a remote-control transmitter. The digital sight is disposed on the firearm body and comprises an image processing module and a receiver electrically connected thereto. The remote-control transmitter is connected to the firearm body, emitting a signal. The receiver receives the signal, actuating the image processing module.

The remote-control transmitter is movably connected to the firearm body.

The remote-control transmitter comprises a transmitter body, a button, and a flexible fixing strap. The button is disposed on the transmitter body. The transmitter body is connected to the flexible fixing strap. The flexible fixing strap is movably fit on the firearm body.

The image processing module comprises a refractive prism, an image sensing unit, and a circuit board. The receiver and image sensing unit are electrically connected to the circuit board. The refractive prism is adjacent to the image sensing unit.

The digital sight further comprises a key set and an LCD display electrically connected to the circuit board, respectively.

The image sensing unit comprises a CMOS sensor or CCD sensor.

The remote-control transmitter comprises a wireless remote-control transmitter. The receiver comprises a wireless receiver.

The wireless remote-control transmitter comprises an infrared remote-control transmitter. The wireless receiver comprises an infrared receiver.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
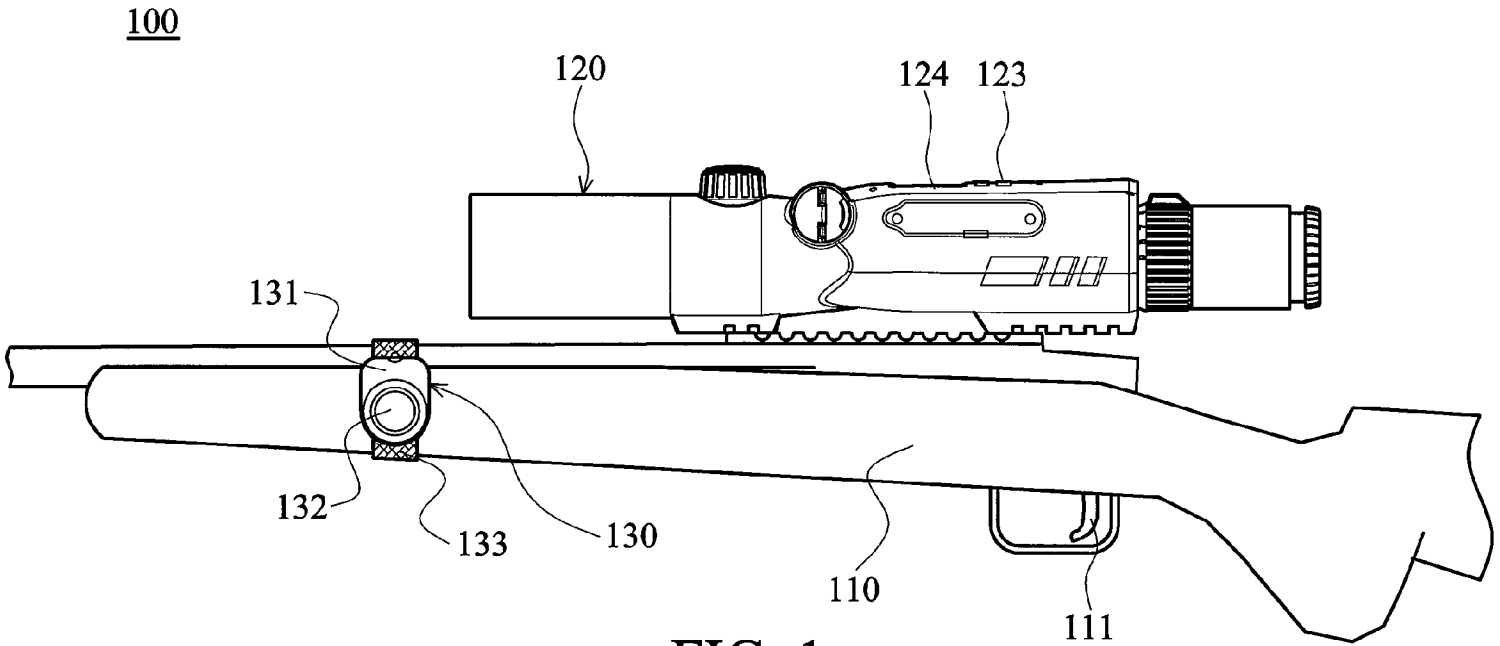
FIG. 1 is a schematic plan view of a firearm aiming and photographing compound apparatus of the invention.
Figure 2:
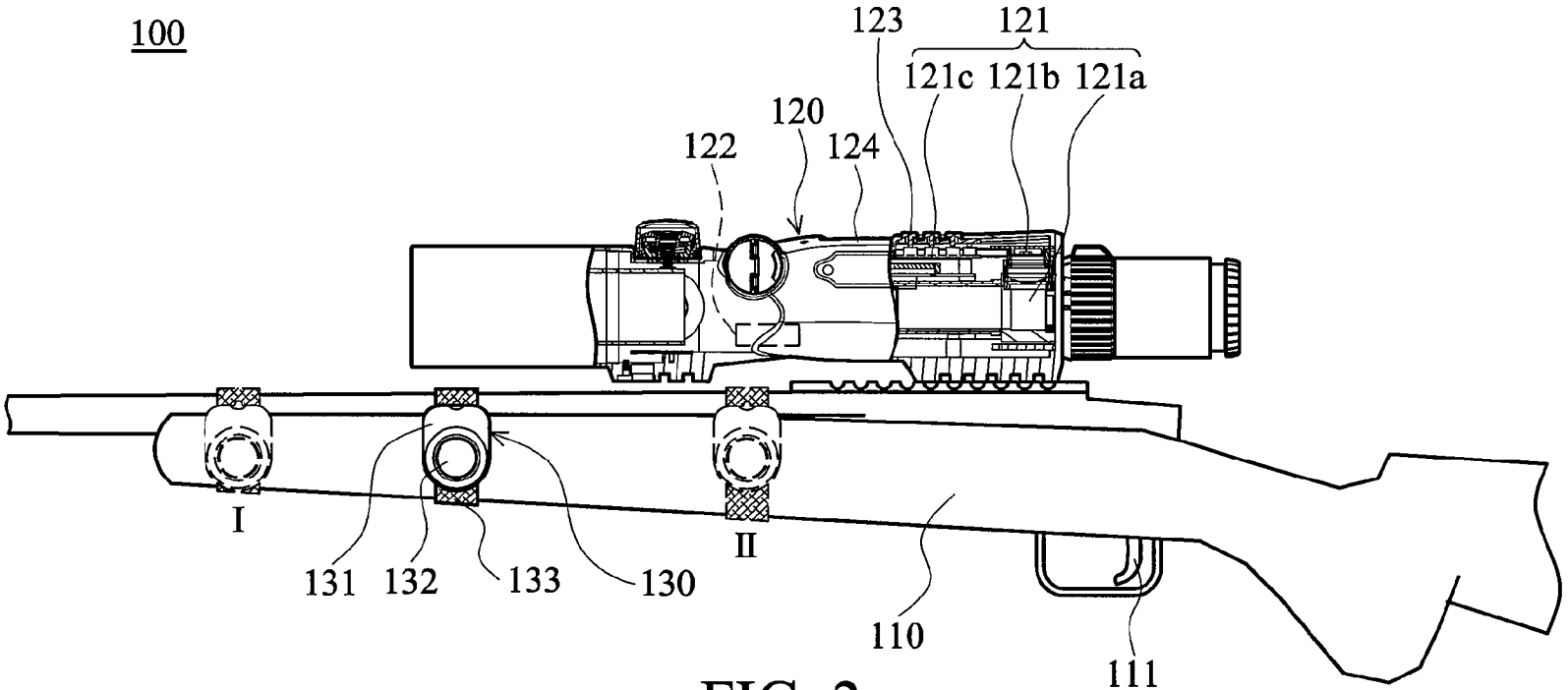
FIG. 2 is a schematic plan view showing partial inner structure of the firearm aiming and photographing compound apparatus of the invention.

Referring to FIG. 1 and FIG. 2, a firearm aiming and photographing compound apparatus 100 comprises a firearm body 110, a digital sight 120, and a remote-control transmitter 130.

The firearm body 110 of this embodiment may be a butt of a rifle or a shotgun.

The digital sight 120 is disposed on the firearm body 110 and comprises an image processing module 121, a receiver 122, a key set 123, and an LCD display 124. The receiver 122 is electrically connected to the image processing module 121. Specifically, as shown in FIG. 2, the image processing module 121 comprises a refractive prism 121*a*, an image sensing unit 121*b*, and a circuit board 121*c*. The image sensing unit 121*b*, receiver 122, key set 123, and LCD display 124 are electrically connected to the circuit board 121*c*, respectively. The refractive prism 121*a* is adjacent to the image sensing unit 121*b*. When transmitted to the digital sight 120, light with images is refracted, by the refractive prism 121*a*, to the image sensing unit 121*b* and received thereby. At this point, the images are displayed on the LCD display 124 and can be captured by operating the key set 123. Moreover, the image sensing unit 121*b*, of this embodiment, may be a CMOS sensor or a CCD sensor.

The remote-control transmitter 130 is movably connected to the firearm body 110, emitting a signal. Specifically, as shown in FIG. 1 and FIG. 2, the remote-control transmitter 130 comprises a transmitter body 131, a button 132, and a flexible fixing strap 133. The button 132 is disposed on the transmitter body 131. The transmitter body 131 is connected to the flexible fixing strap 133. The flexible fixing strap 133 is movably fit on the firearm body 110. By the flexible fixing strap 133, the remote-control transmitter 130 can be positioned between a first position I and a second position II on the firearm body 110, as shown in FIG. 2.

When a user aims at a target using the digital sight 120 of the firearm aiming and photographing compound apparatus 100 and is ready to shoot the target, one hand supports the firearm body 110 (butt) and the other hand slightly contacts a trigger 111 of the firearm body 110. At this point, when also wanting to photograph the target using the digital sight 120, the user can press the button 132 of the remote-control transmitter 130 directly by the hand supporting the firearm body 110, forcing the transmitter body 131 to emit a signal. Accordingly, the receiver 122 disposed in the digital sight 120 receives the signal emitted from the transmitter body 131 and thereby actuates the image processing module 121. The image of the target is thus captured.

Accordingly, while aiming at the target, the user can press the button 132 of the remote-control transmitter 130 by a thumb without removing the hand from the firearm body 110 (butt). Thus, the user's line of sight does not leave the target, and aiming posture does not change, ensuring precision of aiming at or photographing the target. Further, because the user can captured the image of the target without removing the hand from the firearm body 110 (butt) and adjust the position of the remote-control transmitter 130 on the firearm body 110 (butt) as required, convenience of operation of the firearm aiming and photographing compound apparatus 100 is enhanced.

Moreover, the remote-control transmitter 130 may be a wireless or infrared remote-control transmitter, and the receiver 122 be a wireless or infrared receiver.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A firearm aiming and photographing compound apparatus, comprising:

a firearm body;

a digital sight disposed on the firearm body and comprising an image processing module and a receiver electrically connected thereto, wherein the image processing module comprises a refractive prism, an image sensing unit, and a circuit board, the receiver and image sensing unit are electrically connected to the circuit board, and the refractive prism is adjacent to the image sensing unit; and a remote-control transmitter connected to the firearm body, emitting a signal, wherein the receiver receives the signal, actuating the image processing module.

2. The firearm aiming and photographing compound apparatus as claimed in claim 1, wherein the remote-control transmitter is movably connected to the firearm body.

3. The firearm aiming and photographing compound apparatus as claimed in claim 2, wherein the remote-control transmitter comprises a transmitter body, a button, and a flexible fixing strap, the button is disposed on the transmitter body, the transmitter body is connected to the flexible fixing strap, and the flexible fixing strap is movably fit on the firearm body.

4. The firearm aiming and photographing compound apparatus as claimed in claim 1, wherein the digital sight further comprises a key set and an LCD display electrically connected to the circuit board, respectively.

5. The firearm aiming and photographing compound apparatus as claimed in claim 1, wherein the image sensing unit comprises a CMOS sensor or a CCD sensor.

6. The firearm aiming and photographing compound apparatus as claimed in claim 1, wherein the remote-control transmitter comprises a wireless remote-control transmitter, and the receiver comprises a wireless receiver.

7. The firearm aiming and photographing compound apparatus as claimed in claim 6, wherein the wireless remote-control transmitter comprises an infrared remote-control transmitter.

8. The firearm aiming and photographing compound apparatus as claimed in claim 6, wherein the wireless receiver comprises an infrared receiver.

* * * * *